US009485592B2

(12) United States Patent
Riepenhoff

(10) Patent No.: US 9,485,592 B2
(45) Date of Patent: Nov. 1, 2016

(54) HEARING INSTRUMENT COMPRISING TWO ANTENNAS

(71) Applicant: Sonova AG, Stäfa (CH)

(72) Inventor: Matthias Riepenhoff, Zürich (CH)

(73) Assignee: Sonova AG, Staefa (CH)

( * ) Notice: Subject to any disclaimer, the term of this patent is extended or adjusted under 35 U.S.C. 154(b) by 0 days.

(21) Appl. No.: 14/439,820

(22) PCT Filed: Dec. 4, 2012

(86) PCT No.: PCT/EP2012/074327

§ 371 (c)(1),
(2) Date: Apr. 30, 2015

(87) PCT Pub. No.: WO2014/086392

PCT Pub. Date: Jun. 12, 2014

(65) Prior Publication Data

US 2015/0289067 A1 Oct. 8, 2015

(51) Int. Cl.

| | |
|---|---|
| ***H04R 25/00*** | (2006.01) |
| ***H01Q 1/27*** | (2006.01) |
| ***H01Q 21/28*** | (2006.01) |
| *H01Q 1/22* | (2006.01) |

(52) U.S. Cl.

CPC ..... *H04R 25/556* (2013.01); *H01Q 1/273* (2013.01); *H01Q 21/28* (2013.01); *H04R 25/552* (2013.01); *H04R 25/554* (2013.01); *H01Q 1/2291* (2013.01); *H04R 25/305* (2013.01); *H04R 25/558* (2013.01); *H04R 2225/021* (2013.01); *H04R 2225/025* (2013.01); *H04R 2225/51* (2013.01); *H04R 2225/55* (2013.01); *H04R 2460/03* (2013.01)

(58) Field of Classification Search

CPC .. H01Q 21/28; H01Q 1/2291; H04R 25/305; H04R 25/552; H04R 25/554; H04R 25/556; H04R 25/558; H04R 2225/025; H04R 2225/55; H04R 2460/03

USPC ..... 381/312, 322, 327, 330

See application file for complete search history.

(56) References Cited

U.S. PATENT DOCUMENTS

| | | | | |
|---|---|---|---|---|
| 5,721,783 | A * | 2/1998 | Anderson | H04B 1/385 381/312 |
| 7,260,234 | B2 | 8/2007 | Kasztelan et al. | |
| 8,155,335 | B2 * | 4/2012 | Rutschman | H04M 1/6066 381/384 |
| 8,369,959 | B2 * | 2/2013 | Meskens | A61N 1/08 607/33 |
| 8,526,648 | B2 | 9/2013 | Dijkstra et al. | |
| 2006/0177081 | A1 * | 8/2006 | Bauml | H04R 25/353 381/315 |

(Continued)

FOREIGN PATENT DOCUMENTS

| | | |
|---|---|---|
| DE | 10 2010 026 378 A1 | 7/2011 |
| EP | 2 076 065 A1 | 7/2009 |

(Continued)

*Primary Examiner* — Brian Ensey
(74) *Attorney, Agent, or Firm* — David S. Safran

(57) ABSTRACT

A hearing instrument to be worn at an ear of a user, having a first part (18) to be located at least in part in the ear canal, a first antenna (22) to be located substantially within the ear canal, a second part (16) to be worn outside the ear canal at the concha and a second antenna (24) to be located outside the ear canal, wherein the first antenna is to be operated by a first transceiver (46) in a first frequency range and the second antenna is to be operated by a second transceiver (38) in a second frequency range which is higher than the first frequency range.

30 Claims, 3 Drawing Sheets

(56) References Cited

U.S. PATENT DOCUMENTS

2012/0002830 A1 1/2012 Solum
2012/0087506 A1 4/2012 Özden

FOREIGN PATENT DOCUMENTS

WO 2008/089784 A1 7/2008
WO 2012/092973 A1 7/2012

* cited by examiner

HEARING INSTRUMENT COMPRISING TWO ANTENNAS

BACKGROUND OF THE INVENTION

1. Field of the Invention

The invention relates a hearing instrument comprising a first part to be worn at least in part within the ear canal (typically designed as an ITE ("in-the-ear") part) and a second part to be worn outside the ear canal at the concha (typically designed as a BTE ("behind-the-ear") part), with the hearing instrument being suitable for wireless communication.

2. Description of Related Art

Hearing instruments may be designed for wireless communication with various devices, such as for communication with another hearing instrument that is located at the other ear of the user, a body worn relay device forwarding an audio signal to the hearing instrument, a remote control, a mobile phone, a TV set gateway, a wireless microphone, etc. Communication to different types of such devices may occur in different frequency bands: for example, communication between body worn devices typically takes place via an inductive link operating, for example, around 11 MHz, wherein communication to a mobile phone typically uses a Bluetooth link operating at 2.4 GHz.

U.S. Patent Application Publication 2012/0002830 A1 relates to a hearing instrument, such as a BTE, ITE, ITC ("in-the-canal") or CIC ("completely-in-the-canal") hearing aid comprising a high frequency radio using a first antenna and a low frequency radio using a second antenna; the high frequency radio may operate at 2.4 GHz, and the low frequency radio may operate at 30 MHz. It is also mentioned that hearing aids of the BTE type may comprise a receiver (loudspeaker) located in the ear channel; such devices are also known as "receiver-in-the-channel" (RIC) or "receiver-in-the-ear" (RITE) hearing aids.

International Patent Application Publication WO 2008/089784 A1 and corresponding U.S. Pat. No. 8,526,648 relate to a hearing assistance system comprising a wireless microphone for transmitting a voice signal captured by the microphone via a wireless link to a receiver unit connected to a hearing aid, with both the hearing aid and the receiver unit comprising an antenna. The antenna of the hearing aid may be designed for a digital link for binaural communication with a hearing aid worn at the other ear, and the antenna of the receiver unit may be designed for an analog frequency modulation audio link.

EP 1 389 891 A1 and corresponding U.S. Pat. No. 7,260,234 B2 relates to a hearing aid wherein an antenna coil is realized by windings around the electro-acoustic output transducer (loudspeaker) of the hearing aid in order to provide for a relatively large antenna coil.

Patent Application Publication 2012/0087506 A1 relates to a binaural hearing aid system wherein each hearing aid comprises an antenna suitable for establishing a Bluetooth link between the hearing aids; the hearing aids may be of the BTE type or the ITE type.

It lies in the nature of hearing aids that the daily time of use is relatively high in comparison to other hearing devices like communication devices. At the same time, their physical dimensions are generally very limited. The requirements regarding power consumption or electromagnetic emissions are therefore more challenging than for hearing instruments in general.

While Bluetooth technology is widely available, one disadvantage is the relatively high power consumption of a Bluetooth link between two hearing devices.

SUMMARY OF THE INVENTION

It is an object of the invention to provide for a hearing instrument having wireless communication capability, wherein communication with devices utilizing different frequency ranges should be optimized.

According to the invention, this object is achieved by a hearing instrument as described herein.

The invention is beneficial in that, by providing a first part of the hearing instrument with a first antenna to be located substantially within the ear channel and by providing a second part of the hearing instrument with a second antenna to be located outside the ear channel at the user's head, with the first antenna being operated in a first frequency range and the second antenna being operated in a second frequency range higher than the first frequency range, the adsorption of electromagnetic waves by human tissue reduces electromagnetic interaction between the two antennas, while quality and power efficiency of the respective wireless link to the respective external device is maintained or optimized; this makes use of the fact that low frequency radiation is less strongly adsorbed by human tissue than high frequency radiation.

Because of the strong interaction between human tissue and high frequency electromagnetic waves it might be desired to reduce the number of Bluetooth links in vicinity of the body for health reasons. The invention is beneficial because it allows the electromagnetic radiation near the human body to be reduced in comparison to other wireless solutions.

Preferably, the first frequency range is within a range of 5 to 30 MHz, which range is typically used in inductive links of body worn devices, such as HIBAN ("Hearing Instrument Body Area Network") links, and the second frequency range preferably is centered at 2.4 GHz for enabling a Bluetooth connection.

Hereinafter, examples of the invention will be described with reference to the accompanying drawings.

DETAILED DESCRIPTION OF THE INVENTION

A hearing instrument of the present invention comprises a first part to be located at least in part in the ear canal and comprising a first antenna to be located substantially within the ear canal and a second part to be worn outside the ear canal at the concha and comprising a second antenna to be located outside the ear canal; typically, the first part is designed as an ITE part and the second part is designed as a BTE part. However, the second part also may be positioned in front of the concha or be attached at the concha.

Figure 1:
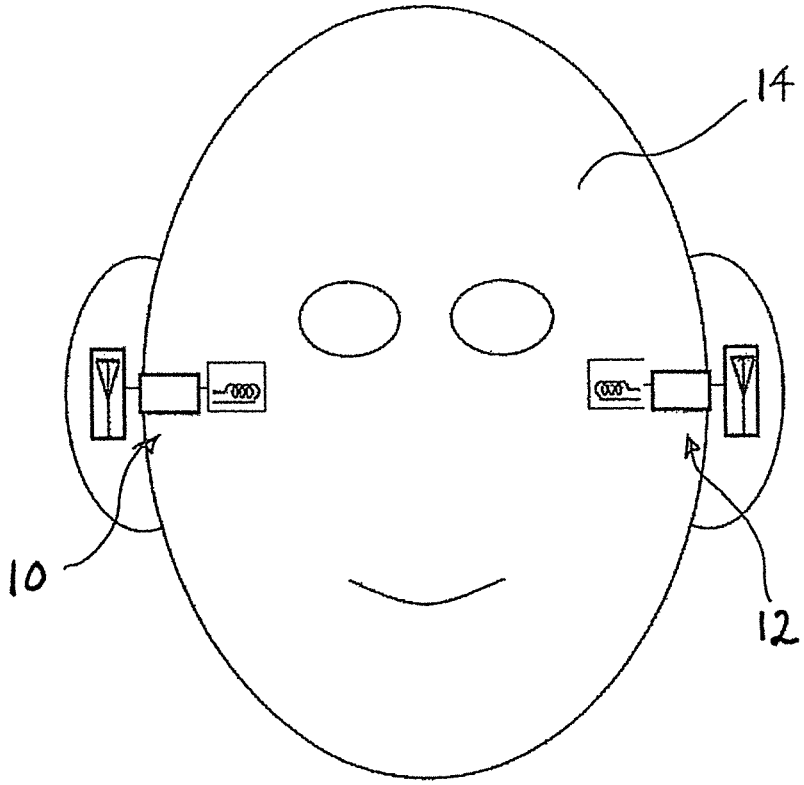
FIG. 1 is a schematic illustration of an example of a binaural hearing system worn by a user and comprising two hearing instruments according to the invention.

FIG. 1 is a schematic illustration of an example of a binaural system comprising a first hearing instrument 10 and a second hearing instrument 12, each one at one ear of a user's head 14.

Figure 2:
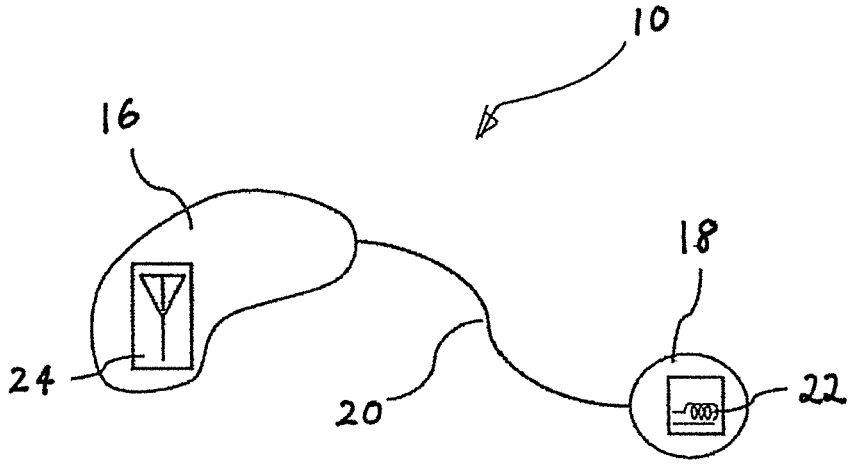
FIG. 2 is a schematic representation of one of the hearing instruments of FIG. 1.

According to FIG. 2, the hearing instrument 10 comprises a BTE part 16 and an ITE part 18, which are connected via a connection 20 which provides for an electrical wire connection and also may comprise, in case that the ITE part does not comprise a loudspeaker, a sound tube for conducting sound from a loudspeaker of the BTE part to the ITE part.

The ITE part 18 comprises a first antenna 22, and the BTE part 16 comprises a second antenna 24. The first antenna 22 is located within the ear channel when the hearing instrument 10 is worn, and the second antenna 24 is located outside the ear channel at the user's head 14. The first antenna 22 is for being used in communication in a first frequency range and the second antenna 24 is for being used in communication in a second frequency range higher than the first frequency range. Typically, the first frequency range, i.e., the first communication band, is below 100 MHz, and preferably within a range of 5 MHz to 30 MHz. For example, the first frequency range may be centered at 11 MHz for use in a HIBAN. Typically, the first antenna 22 is constructed for an inductive connection and may be designed as a coil or a loop antenna.

In order to reduce the power consumption of the communication link of the hearing devices of a binaural hearing system the distance between their antennas should be minimized. It is therefore advantageous to place the first antenna near the ear drum. Preferably, the ITE part 18 is designed such that the distance of the first antenna 22 to the user's ear drum is less than 8 mm, when the ITE part 18 is inserted into the ear channel.

Figure 3:
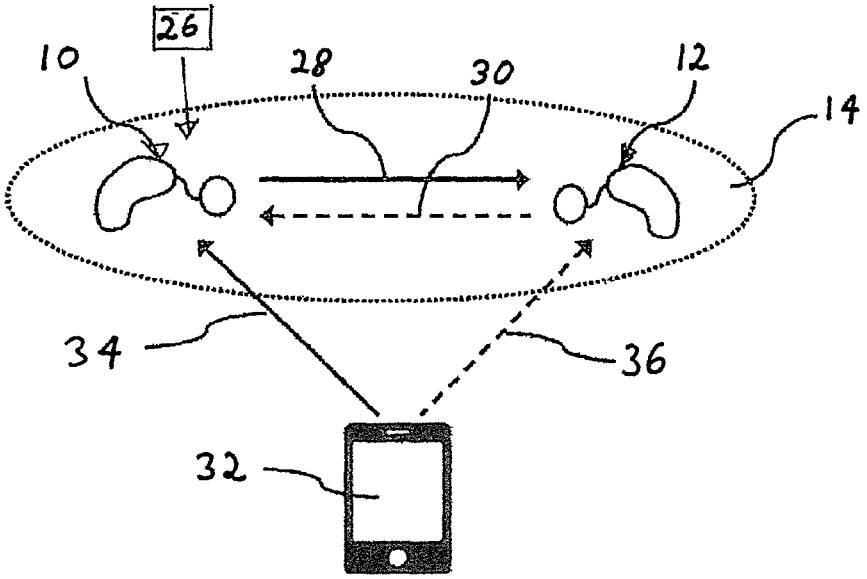
FIG. 3 is a schematic illustration of the communication of the hearing instruments of FIG. 1 with each other and with an external device.

Typically, the first antenna is in communication with a device to be worn at the body of the user. In the example of FIGS. 1 to 3 the first antenna 22 is for establishing a binaural link between the first hearing instrument 10 and the second hearing instrument 12 which usually is of the same type as the first hearing instrument 10.

According to another example, the first antenna 22 may be used for communication with an accessory device 26, for example, a remote control.

The first antenna may be used for audio streaming within the HIBAN. Audio signals may be streamed between two hearing devices 10, 12 of a binaural hearing system or between a hearing device and the accessory device 26.

The second antenna 24 typically is for communication with an external device which is not part of the HIBAN and which may be located in proximity or remote from the user's body. Examples of external devices communicating with the hearing instrument via the second antenna 24 include telecommunication devices, such as mobile phones, audio devices, such as a wireless microphone, data processing devices, hearing instrument fitting devices or data network connecting devices, such as an internet connection.

Typically, the second frequency range is above 400 MHz, preferably above 0.9 GHz and more preferably above 1.8 GHz. For example, the second frequency range may be centered at 2.4 GHz, so that the second antenna 24 may be used in a Bluetooth connection or in any other high frequency (radio frequency) protocol. The second antenna may be, for example, a dipole antenna or a loop antenna or any other antenna suitable for working in the second frequency range. Preferably, the ratio of the center frequency of the second frequency range to the center frequency of the first frequency range is more than 10.

In FIG. 3 a schematic example is shown of how the hearing instruments 10, 12 may wirelessly communicate. For example, the two hearing instruments 10, 12 may communicate with each other via an inductive link 28, 30 in order to implement a binaural system, wherein audio data and/or other data is exchanged using the first antenna 22 of each hearing instrument 10, 12. At the same time, each hearing instrument 10, 12 may communicate with a Bluetooth device 32 via a Bluetooth link 34, 36 using the second antenna 24 of each hearing instrument 10, 12. The Bluetooth device 32 may be, for example, a mobile phone which transmits the received voice signals via the Bluetooth link 34, 36 for the hearing instruments 10, 12.

It is possible to establish Bluetooth links 34 and 36 at the same time in order to transmit signals, for example an audio signal, to both hearing instruments 10 and 12. A preferred operation mode however is, to establish just one Bluetooth link 34 to device 10 and to forward the signal from device 10 to device 12 using the HIBAN link 28. In this case the power consumption of hearing instrument 10 is higher than the power consumption of hearing instrument 12, but the total power consumption of the system is reduced. Depending on state of charge of the batteries of hearing instruments 10 or 12 or on other factors like the quality of link 34 in comparison with a potential quality of link 36 or the preference of a user the system may automatically or manually be switched to an operation mode in which the Bluetooth link 36 is active and the signal which is transmitted via link 36 to hearing instrument 12 is forwarded to hearing instrument 10 via HIBAN link 30. The information regarding state of charge of the batteries of hearing instruments 10, 12 or a quality of the link 34, 36 could be exchanged between the hearing instruments 10, 12 via the HIBAN link 28, 30.

Figure 4:
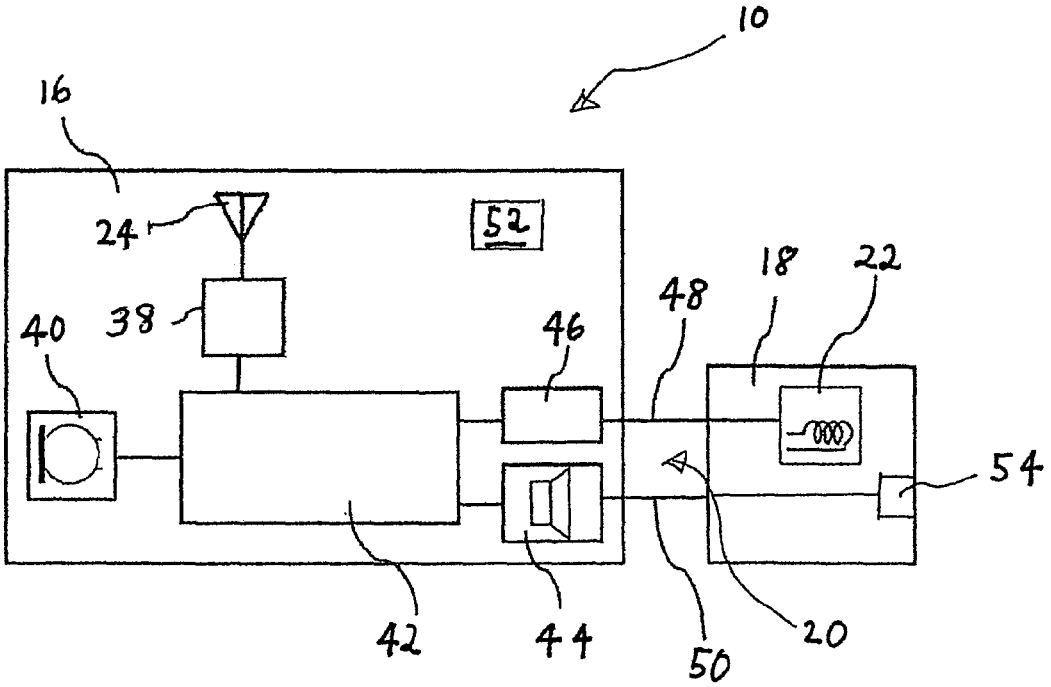
FIG. 4 is a block diagram of an example of a hearing instrument according to the invention.

In FIG. 4, a block diagram of a first example of a hearing instrument 10 is shown, wherein the BTE part 16 comprises, in addition to the second antenna 24, a transceiver 38 for operating the antenna 24, a microphone 40 for capturing an audio signal from ambient sound, a processor 42 acting as an audio signal processing unit for processing the captured audio signal and acting as a controller, a loudspeaker 44 for producing sound according to the processed audio signal, a power source 52, and a transceiver 46 for operating the first antenna 22 of the ITE part 18. The connection 20 between the BTE part 16 and the ITE part 18 comprises electrical wires 48 for electrically connecting the second antenna 22 and the transceiver 46 and a sound tube 50 for conducting sound produced by the speaker 44 into the ear channel via a sound outlet 54 of the ITE part 18.

Figure 5:
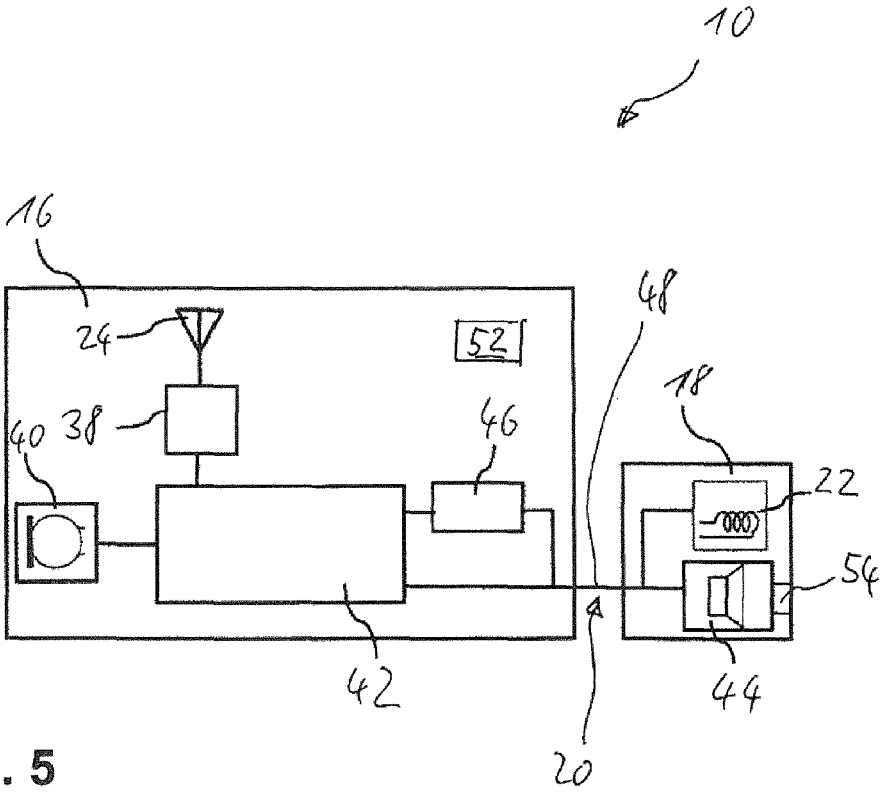
FIG. 5 is a view like FIG. 4, wherein an alternative example is shown.

An alternative example is shown in FIG. 5, wherein the loudspeaker 44 is provided in the ITE part 18 rather than in the BTE part 16. In this case, the connection 20 does not comprise a sound tube but rather an electrical wire connection for supplying the processed audio signals to the speaker 44. The processed audio signal and the signal exchanged between the transceiver 46 and the first antenna 22 may be conducted by separate wires or the signals may share wires by applying known signal multiplexing; also power may be supplied via signal wires (phantom power). The loudspeaker signal and the antenna signal may be decoupled, for example, by using L/C filters.

Figure 6:
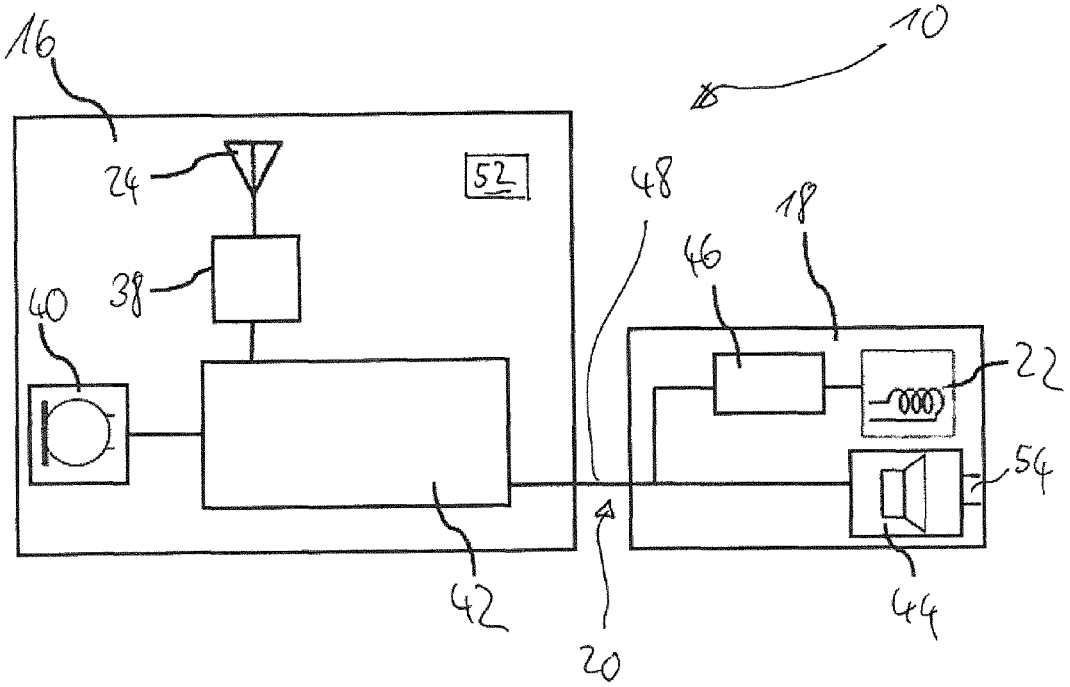
FIG. 6 is a view like FIG. 4, wherein a further alternative example is shown.

A further alternative example is shown in FIG. 6, wherein the transceiver 46 driving the first antenna 22 is provided as part of the ITE part 18. The digital connection between the transceiver 46 and the processor 42 may be established using the same electrical wires 48 as the speaker signal, or it may use separate electrical wires. The embodiment of FIG. 6 is preferred over the variants of FIGS. 4 and 5.

While three examples of the design of the ITE part and the BTE part are shown, alternative configurations are conceivable as well. For example, the processor 42 or part of its functions may be placed in the ITE part 18. In such case, the connection 20 would be used for exchanging digital data between the BTE part 16 and the ITE part 18. Also the transceiver 38 driving the second antenna 24 may be located in the ITE part 18. In general, the transceiver for driving an antenna may be located in the same part as the antenna or in the other part.

In case that the transceiver 46 of the first antenna 22 is located in the ITE part 18, the second antenna 22 may at least partially protrude outside the ear channel and may be combined for example with a pull-out wire. In any case, the first antenna 22 is placed at least substantially within the ear channel, i.e., at least half of the antenna is placed within the ear channel.

What is claimed is:

1. A hearing instrument to be worn at an ear of a user, comprising a first part adapted to be located at least in part in the ear canal and comprising a first antenna to be located substantially within the ear canal;

a second part adapted to be to be worn outside the ear canal at the concha and comprising a second antenna to be located outside the ear canal, the second part being connected to the first part via an electrical wire;

wherein the first antenna is adapted to be operated by a first transceiver in a first frequency range and the second antenna is adapted to be operated by a second transceiver in a second frequency range which is higher than the first frequency range.

2. The hearing instrument of claim 1, wherein the first antenna is constructed to be inductively connected.

3. The hearing instrument of claim 2, wherein the first antenna is a coil or a loop antenna.

4. The hearing instrument of claim 1, wherein the first frequency range is below 100 MHz.

5. The hearing instrument of claim 4, wherein the first frequency range is within a range of 5 MHz to 30 MHz.

6. The hearing instrument of claim 5, wherein the first frequency range is centered at 11 MHz.

7. The hearing instrument of claim 1, wherein the first part is constructed for enabling the distance of the first antenna from the user's ear drum to be less than 8 mm when the first part is inserted into the ear canal.

8. The hearing instrument of claim 1, wherein the first antenna is locatable completely within the ear canal.

9. The hearing instrument of claim 1, wherein the second frequency range is above 400 MHz.

10. The hearing instrument of claim 9, wherein the second frequency range is centered at 2.4 GHz.

11. The hearing instrument of claim 10, wherein the second transceiver and the second antenna are Bluetooth connectable.

12. The hearing instrument of claim 1, wherein the ratio of a center frequency of the second frequency range relative to a center frequency of the first frequency range is more than 10.

13. The hearing instrument of claim 1, wherein the second antenna is a dipole antenna or loop antenna.

14. The hearing instrument of claim 1, wherein the second part comprises a microphone arrangement for capturing an audio signal from ambient sound, an audio signal processing unit for processing the captured audio signal, a power source, the first transceiver, the second transceiver, and a loudspeaker for producing sound according to processed audio signals, wherein a connection connecting the second part and the first part is provided that comprises a wire connection that connects the first transceiver to the first antenna and a sound tube for conducting sound from the loudspeaker to a sound outlet of an in-the-ear part.

15. The hearing instrument of claim 1, wherein the second part comprises a microphone arrangement for capturing an audio signal from ambient sound, an audio signal processing unit for processing a captured audio signal, a power source, the first transceiver and the second transceiver, wherein the first part comprises a loudspeaker for producing sound according to processed audio signals and wherein a connection that connects the second part and the first part is provided, the connection comprising a wire connection connecting the first transceiver to the first antenna and the audio signal processing unit to the loudspeaker.

16. The hearing instrument of claim 1, wherein the second part comprises a microphone arrangement for capturing an audio signal from ambient sound, an audio signal processing unit for processing the captured audio signal, a power source, and the second transceiver, wherein the first part comprises the first transceiver and a loudspeaker for producing sound according to the processed audio signals, and wherein a connection connects the second part and the first part, the connection comprising a wire connection for connecting the first transceiver to a processor of the first part and the audio signal processing unit to the loudspeaker.

17. The hearing instrument of claim 1, wherein the first part is an in-the-ear part.

18. The hearing instrument of claim 1, wherein the second part is a behind-the-ear part.

19. A system comprising:

a hearing instrument, comprising a first part adapted to be located at least in part in the ear canal and comprising a first antenna to be located substantially within the ear canal;

a second part adapted to be to be worn outside the ear canal at the concha and comprising a second antenna to be located outside the ear canal, the second part being connected to the first part via an electrical wire;

wherein the first antenna is adapted to be operated by a first transceiver in a first frequency range and the second antenna is adapted to be operated by a second transceiver in a second frequency range which is higher than the first frequency range, a first device that is adapted to communicate with the hearing instrument via the first antenna in the first frequency range, and a second device which is adapted to communicate with the hearing instrument via the second antenna in the second frequency range.

20. The system of claim 19, wherein the second device is a device selected from the group consisting of a telecommunication device, an audio device, a data processing device, a fitting device or a data network connecting device.

21. The system of claim 19, wherein said first device is one of a second hearing instrument to be worn at another ear of the user and an accessory device.

22. The system of claim 19, wherein said first device is a remote control.

23. A method of operating a system comprising a first hearing instrument, a second hearing instrument, the hearing instruments comprising a first part adapted to be located at least in part in the ear canal and comprising a first antenna to be located substantially within the ear canal, a second part adapted to be to be worn outside the ear canal at the concha, the second part being connected to the first part via an electrical wire and comprising a second antenna to be located outside the ear canal; and an external device, comprising the steps of:

using the first antenna of the hearing instruments for establishing an inductive data connection between the first hearing instrument and the second hearing instrument, transmitting data in a first operation mode from the external device via a first wireless link to the first hearing instrument, said first wireless link using the second antenna of the first hearing instrument and forwarding data received via the first wireless link by the first hearing instrument via an inductive link to the second hearing instrument, and transmitting data in a second operation mode data from the external device via a second wireless link to the second hearing instrument, said second wireless link using the second antenna of the second hearing instrument, and forwarding data received by the second hearing instrument via the second wireless link via the inductive link to the first hearing instrument.

24. The method of claim 23, wherein operation in the first or second operation mode is selected automatically based on at least one of a battery status of the first and second hearing instruments and quality of the first and second wireless link.

25. The method of claim 24, wherein information concerning said at least one of the battery status of the first and second hearing instrument and the quality of the first and second wireless link is exchanged between the hearing instruments via the inductive link.

26. The method of claim 23, wherein the user manually selected which of the first and second operation modes is in operation.

27. The method of claim 23, wherein the inductive link is a HIBAN link.

28. The method of claim 23, wherein the first wireless and the second wireless link, respectively, are used for streaming of an audio signal.

29. The method of claim 23, wherein the first wireless link and the second wireless link are radio frequency links.

30. The method of claim 23, wherein the first wireless link and the second wireless link are Bluetooth links.

* * * * *